US006038902A

United States Patent [19]

Talley et al.

[11] Patent Number: 6,038,902

[45] **Date of Patent: *Mar. 21, 2000**

[54] INTRADOS INDUCTION HEATING FOR TIGHT RADIUS ROTARY DRAW BEND

[75] Inventors: Laroul J. Talley, Brookston, Tex.; Theodore F. Yurek, Alliance; Douglas D. Ziegler, Atwater, both of Ohio; Ross G. Robinson, Brentford, Canada

[73] Assignee: The Babcock & Wilcox Company, New Orleans, La.

[ * ] Notice: This patent issued on a continued prosecution application filed under 37 CFR 1.53(d), and is subject to the twenty year patent term provisions of 35 U.S.C. 154(a)(2).

[21] Appl. No.: 09/012,507

[22] Filed: Jan. 23, 1998

[51] Int. Cl.[7] ..... B21D 7/16

[52] U.S. Cl. ..... 72/128; 72/369

[58] Field of Search ..... 72/128, 369

[56] References Cited

U.S. PATENT DOCUMENTS

| | | | |
|---|---|---|---|
| 3,229,489 | 1/1966 | Huet | 72/128 |
| 4,596,128 | 6/1986 | Ringersma et al. | 72/128 |
| 5,491,996 | 2/1996 | Baarman et al. | 72/369 |

FOREIGN PATENT DOCUMENTS

| | | | |
|---|---|---|---|
| 60-180623 | 9/1985 | Japan | 72/128 |
| 62-13218 | 1/1987 | Japan | 72/128 |
| 63-171220 | 7/1988 | Japan | 72/128 |

*Primary Examiner*—Lowell A. Larson

*Attorney, Agent, or Firm*—Robert J. Edwards; Eric Marich

[57] ABSTRACT

A boost bend method of making tight radius bends in boiler tubes, such as bends having a radius of 1×D or less, in which a selected portion of the intrados of the tube is heated in a controlled manner thereby reducing the necessary tube wall thickness relative to the diameter of the tube for 180° bends. Tubes bent using the method may have wall thicknesses of about 6.6% of the tube diameter and suffer less than about 7% thinning of the extrados tube wall.

9 Claims, 1 Drawing Sheet

INTRADOS INDUCTION HEATING FOR TIGHT RADIUS ROTARY DRAW BEND

BACKGROUND OF THE INVENTION

1. Field of the Invention

The present invention relates generally to the field of bending boiler tubes for use in a furnace, among other things, and in particular to a new and useful method for rotary draw bending a boiler tube to permit tighter tube bends.

2. Description of the Related Art

Known methods for making tight radius 180 degree return bends (bends having a radius equal to the tube diameter, or 1×D) by rotary draw bending require the boiler tube wall thickness to be at least equal to almost 10% of the tube diameter. Tube clamps are used to clamp the tube and push longitudinally with a hydraulic cylinder to forcibly compress the tube. Simultaneously with the compression, the tube is bent in the desired radius. The compression-bending rotary draw method, also known as "boost bending", reduces the amount of tube wall thinning on the extrados of the bend from 30% without compression to about 15%–25%.

Other methods for reducing the amount of wall thinning in the tube extrados use gas or induction heat to heat the entire tube in the area of the bend prior to bending. These methods can only be used on bends greater than 1×D, and require a minimum wall thickness of 10% of the tube diameter.

Until now, methods for reducing the wall thickness of the tube without sacrificing tube strength of tightly bent tube walls due to wall thinning have not been available.

SUMMARY OF THE INVENTION

It is an object of the present invention to provide a method for making tight radius tube bends with tubes having thinner walls.

It is a further object of the invention to provide a method for further reducing the amount of tube extrados wall thinning from known methods.

Accordingly, a method for making a tight radius tube bend is provided in which the tube intrados is selectively heated immediately prior to boost bending of the tube. A narrow band in the intrados is heated with an inductor coil in a controlled manner immediately prior to the time the tube undergoes boost bending.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
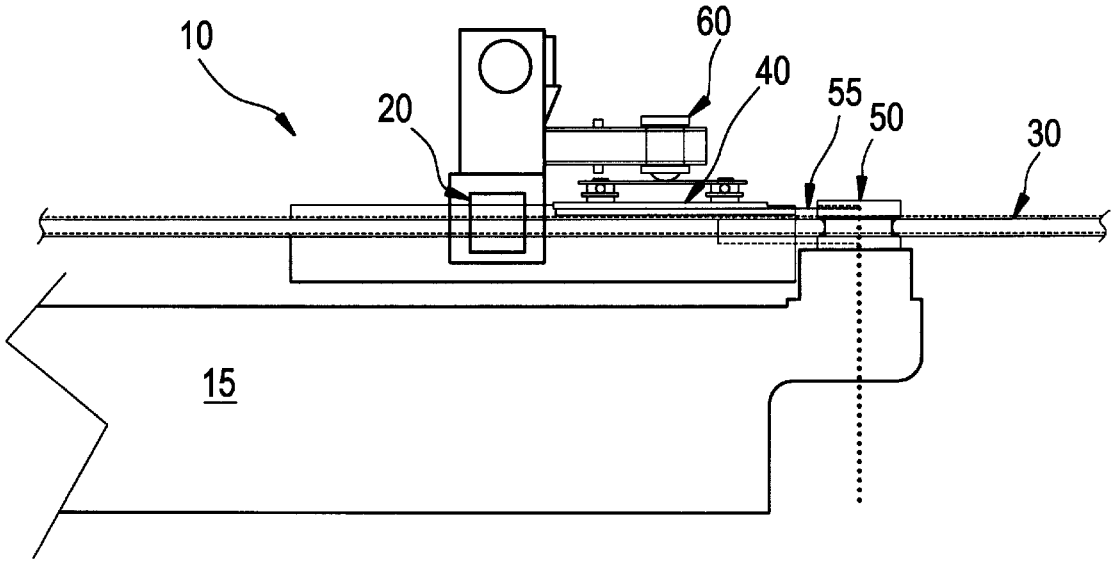
FIG. 1 is a schematic drawing of a boost bender apparatus for practicing the invention.

Referring now to the drawings, in which like reference numerals are used to refer to the same or similar elements, FIG. 1 shows a boost bending apparatus 10 which has been modified to allow selective heating of the intrados side of a boiler tube 30 immediately prior to bending. The boost bending apparatus 10 is used to make bends up to 180° in the tube 30.

A machine base 15 supports a tube clamp 20 for tightly gripping boiler tube 30. Adjacent to tube clamp 20, inductor coil heater 40 is positioned against the intrados side of tube 30. Following heater 40, a pressure die 55 and complimentary bend die 50 are oriented to bend the tube 30 with a desired bend radius.

Tube clamp 20 is used to apply longitudinal pressure to the tube 30 as it is bent between the bend and pressure dies 50, 55, such as with a conventional boost bend machine.

The inductor coil heater 40 positioned between the tube clamp 20 and dies 50, 55 heats a small, concentrated band of tube 30 on the intrados side to improve the bend characteristics of the tube. The inductor coil heater 40 is used to elevate the temperature of a band in the intrados immediately prior to boost bending. The band is approximately 0.5 inches to 0.75 inches wide and between 8 and 9 inches long when a conventional boiler tube (diameter about 2.5") is bent.

Figure 2:
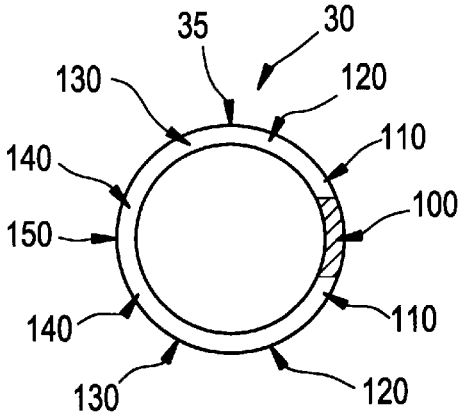
FIG. 2 is a diagram of tube wall temperatures adjacent the bend.

In FIG. 2 the temperature increases on the sections of the tube 30 wall are shown relative to the intrados section 100 and top 35 of the tube 30. The temperature of intrados section 100, which is heated by the inductor coil heater 40, is preferably about 1100° F. The tube wall sections 110 immediately adjacent the intrados section 100 are about 950° F. Nearer to the top 35 and bottom of the tube 30 on the intrados 100 side, wall sections 120 have a temperature of about 800° F.

On the extrados side 150, directly opposite the intrados side 100, the temperature is about 200° F. The temperature gradually rises to 350° F. at region 140 and to 600° F. at region 130 adjacent the top and bottom of the tube 30 on the extrados side 150.

By heating only the narrow band of the intrados 100 immediately prior to boost bending, the temperature of the tube 30 is still elevated as the tube 30 is bent. This temperature difference has the effect of reducing the required wall thickness of the tube 30 in relation to the diameter of the tube 30 since the effect of wall thinning in the extrados 150 of the tube 30 is reduced.

For example, when the method of the invention is practiced by compressing a tube during bending with the boost bending apparatus 10 and heating the intrados of a tube 30 to about 1100° F., with the resulting temperature gradients around the tube circumference, immediately prior to bending the tube about 180°, a tube 30 having a wall thickness approximately 6.6% of the tube diameter can be bent in a tight radius bend with only 7% or less extrados tube wall thinning. According to the invention, tubes having wall thicknesses of 10% of the tube diameter or less may be bent in tight radius bends while experiencing extrados wall thinning of 7% or less. Experimental data supports the improvement in reduced wall thinning with thinner, lighter boiler tubes.

Due to the reduced wall thinning, the radii of tight radius bends made by the invention may be equal to or less than the diameter of the tubes being bent. The invention allows a lighter boiler tube to be bent in small radius bends without reducing the safety and usefulness of the tube, since the walls of the tube are not unduly thinned during bending. Thus, arrays of bent boiler tubes, such as those used for heat transfer in a furnace, may be manufactured at reduced cost of materials and can be made lighter in the same volume as prior arrays, making shipping and installation of boiler tubes easier as well.

While a specific embodiment of the invention has been shown and described in detail to illustrate the application of the principles of the invention, it will be understood that the invention may be embodied otherwise without departing from such principles.

What is claimed is:

1. A method of making a tight radius bend in a tube, the tube having a wall thickness and a diameter, the wall thickness being a function of the radius of the bend, and the tube having a wall thickness which is less than about 10% of the diameter of the tube, the method comprising the step of:

providing the tube;

applying longitudinal compression to the tube;

heating only an intrados of the tube with an inductor coil to create a temperature gradient around a circumference of the tube to untreated sides and an extrados of the tube;

bending the tube in a tight radius bend while applying the longitudinal compression and immediately following heating the intrados, whereby the tube may be bent in a tight radius bend with the extrados of the tube experiencing wall thinning of almost 10% of the original tube wall thickness or less.

2. A method according to claim 1, wherein heating only the intrados comprises heating a selected band of the tube at the intrados, the selected band being an area having a width of between about 8 and 9 inches for a tube diameter of about 2.5 inches.

3. A method according to claim 2, wherein the selected band is heated to about 1100° F., the extrados being about 200° F.

4. A method according to claim 3, wherein the tight radius bend has a bend radius which is equal to the diameter of the tube.

5. A method according to claim 3, wherein the tight radius bend has a bend radius which is less than the diameter of the tube.

6. A method according to claim 3, wherein the temperature gradient produces a temperature about 800° F. at the top and bottom of the tube and about 950° F. adjacent the upper and lower edges of the band.

7. A method according to claim 1, including heating only the intrados of the tube in a band on the intrados on the tube to produce the temperature gradient, bending the tube by holding a portion of the tube in a clamp and using a pressure die and a bend die spaced from the clamp, the heating of the intrados of the tube taking place between the dies and the clamp.

8. A method according to claim 7, wherein the band is about 0.5 to 0.75 inches wide and about 8 to 9 inches long for a tube having a diameter of about 2.5 inches.

9. A method according to claim 8, wherein the intrados band is heated to about 1100° F. to produce a temperature of about 200° F. at the extrados of the band, due to the temperature gradient around the band.

* * * * *